US009530297B2

(12) United States Patent
Oozawa

(10) Patent No.: US 9,530,297 B2
(45) Date of Patent: Dec. 27, 2016

(54) COMMODITY INFORMATION INPUT APPARATUS, EXIT DETECTION APPARATUS, AND SYSTEM INCLUDING THE SAME

(71) Applicant: TOSHIBA TEC KABUSHIKI KAISHA, Shinagawa-ku, Tokyo (JP)

(72) Inventor: Shuji Oozawa, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 27 days.

(21) Appl. No.: 14/525,309

(22) Filed: Oct. 28, 2014

(65) Prior Publication Data

US 2015/0187193 A1 Jul. 2, 2015

(30) Foreign Application Priority Data

Dec. 27, 2013 (JP) ..... 2013-272185

(51) Int. Cl.
*G08B 13/14* (2006.01)
*G08B 13/24* (2006.01)

(52) U.S. Cl.
CPC ..... *G08B 13/2417* (2013.01); *G08B 13/246* (2013.01); *G08B 13/248* (2013.01); *G08B 13/2482* (2013.01)

(58) Field of Classification Search
CPC . G08B 13/242; G08B 13/2417; G08B 13/246; G08B 13/248; G07G 1/0045; G07G 1/009; G06Q 10/08; G06Q 10/087; G06Q 20/20; G06Q 20/203
USPC ..... 340/571, 572.1–572.9, 568.5, 10.1, 340/10.51; 705/16, 22, 28; 235/385, 235/462.45, 462.46, 462.49
See application file for complete search history.

(56) References Cited

U.S. PATENT DOCUMENTS 5,710,540 A * 1/1998 Clement ..... G07G 1/0054 340/572.4
5,729,697 A * 3/1998 Schkolnick ..... G06Q 20/203 235/383
5,955,951 A * 9/1999 Wischerop ..... E05B 73/0017 340/10.42
5,990,794 A * 11/1999 Alicot ..... G08B 13/242 340/572.1
7,031,946 B1 * 4/2006 Tamai ..... G06F 12/1466 705/50

(Continued)

FOREIGN PATENT DOCUMENTS

JP 07-506686 7/1995
JP 09-081859 3/1997

(Continued)

OTHER PUBLICATIONS

Japanese Office Action for Japanese Patent Application No. 2013-272185 mailed on Oct. 18, 2016.

*Primary Examiner* — Thomas Mullen
(74) *Attorney, Agent, or Firm* — Amin, Turocy & Watson LLP

(57) ABSTRACT

In accordance with one embodiment, a gate apparatus comprises an information reception module configured to receive information from an RFID tag attached to a commodity, and a notification module configured to notify an operator of an unsettled message indicating that the commodity is not settled if the information received by the information reception module does not include settlement information indicating that the commodity is settled.

7 Claims, 11 Drawing Sheets

(56) References Cited

U.S. PATENT DOCUMENTS

| | | | | |
|---|---|---|---|---|
| 2012/0044074 | A1* | 2/2012 | Mulla | G06Q 10/08 340/572.1 |
| 2013/0187778 | A1* | 7/2013 | Smith | G08B 13/2417 340/572.1 |
| 2014/0084060 | A1* | 3/2014 | Jain | G06Q 10/087 235/385 |

FOREIGN PATENT DOCUMENTS

| | | |
|---|---|---|
| JP | 10-162245 | 6/1998 |
| JP | 2000-030150 | 1/2000 |
| JP | 2003-196739 | 7/2003 |
| JP | 2005-141374 | 6/2005 |
| JP | 2006-309382 | 11/2006 |
| JP | 2011-191818 | 9/2011 |

* cited by examiner

214b

| COMMODITY CODE | COMMODITY NAME | PRICE | ATTRIBUTION INFORMATION | RFID MANAGING COMMODITY |
|---|---|---|---|---|
| 001 | | | | 1 |
| 002 | | | | 1 |
| 003 | | | | 0 |
| 214b1 | 214b2 | 214b3 | 214b4 | 214b5 |

COMMODITY INFORMATION INPUT APPARATUS, EXIT DETECTION APPARATUS, AND SYSTEM INCLUDING THE SAME

CROSS-REFERENCE TO RELATED APPLICATION

This application is based upon and claims the benefit of priority from Japanese Patent Application No. 2013-272185, filed Dec. 27, 2013, the entire contents of which are incorporated herein by reference.

FIELD

Embodiments described herein relate generally to a commodity information input apparatus, an exit detection apparatus, a system including the commodity information input apparatus and the exit detection apparatus, and a method for inputting settlement information of a commodity.

BACKGROUND

An anti-theft mechanism in which an IC (Integrated Circuit) tag is attached to a commodity to prevent the theft of commodity is introduced into more and more stores such as a supermarket, a drugstore and the like. In accordance with such a mechanism, the IC tag attached to the settled commodity is irradiated with strong electromagnetic wave and the like and is therefore destroyed, thus, a gate arranged at the exit does not react to the destroyed IC tag. On the contrary, the IC tag attached to the unsettled commodity is not destroyed, and the gate still reacts to the IC tag, thus, the gate arranged at the exit reacts to the IC tag and activates a buzzer if a customer is going to intentionally take out the unsettled commodity from the store through the gate.

However, in a case in which the IC tag can still be used because it is not completely destroyed in the settlement process, the gate reacts to the IC tag although the commodity is already settled. Further, there is also a case in which the gate reacts when the commodity settled in other store is taken into the store through the gate. In these cases, troubles are brought to the customers, and the loss of public confidence in the store may be caused.

DETAILED DESCRIPTION

In accordance with one embodiment, a commodity information input apparatus comprises a commodity information input determination module configured to determine whether or not there is an input of commodity information for specifying a commodity, the commodity having an RFID tag attached thereto; and a settlement information sending module configured to send settlement information indicating that the commodity is settled to the RFID tag on the commodity if the commodity information input determination module determines that there is the input of commodity information.

In accordance with one embodiment, an exit detection apparatus comprises an information reception module configured to receive information from an RFID tag attached to a commodity; and a notification module configured to notify an operator of an unsettled message indicating that the commodity is not settled if the information received by the information reception module does not include settlement information indicating that the commodity is settled.

In accordance with one embodiment, a system comprises a commodity information input apparatus in which commodity information for specifying a commodity is input, the commodity information input apparatus including a commodity information input determination module configured to determine whether or not there is the input of commodity information, and a settlement information sending module configured to send settlement information indicating that the commodity is settled to an RFID tag attached to the commodity if the commodity information input determination module determines that there is the input of commodity information; and an exit detection apparatus which manages an unsettled commodity, the exit detection apparatus including an information reception module configured to receive information from the RFID tag attached to the commodity, and a notification module configured to notify an operator of an unsettled message indicating that the commodity is not settled if the information received by the information reception module does not include the settlement information indicating that the commodity is settled.

Hereinafter, one embodiment of the present invention is described with reference to the accompanying drawings. The embodiment is just exemplified as one example of the commodity information input apparatus, the exit detection apparatus, the system and the method, and is not intended to limit the constitutions and the specifications of the apparatuses. In the embodiment, a scanner apparatus is exemplified as an example of the commodity information input apparatus and a gate apparatus is exemplified as an example of the exit detection apparatus.

Figure 1:
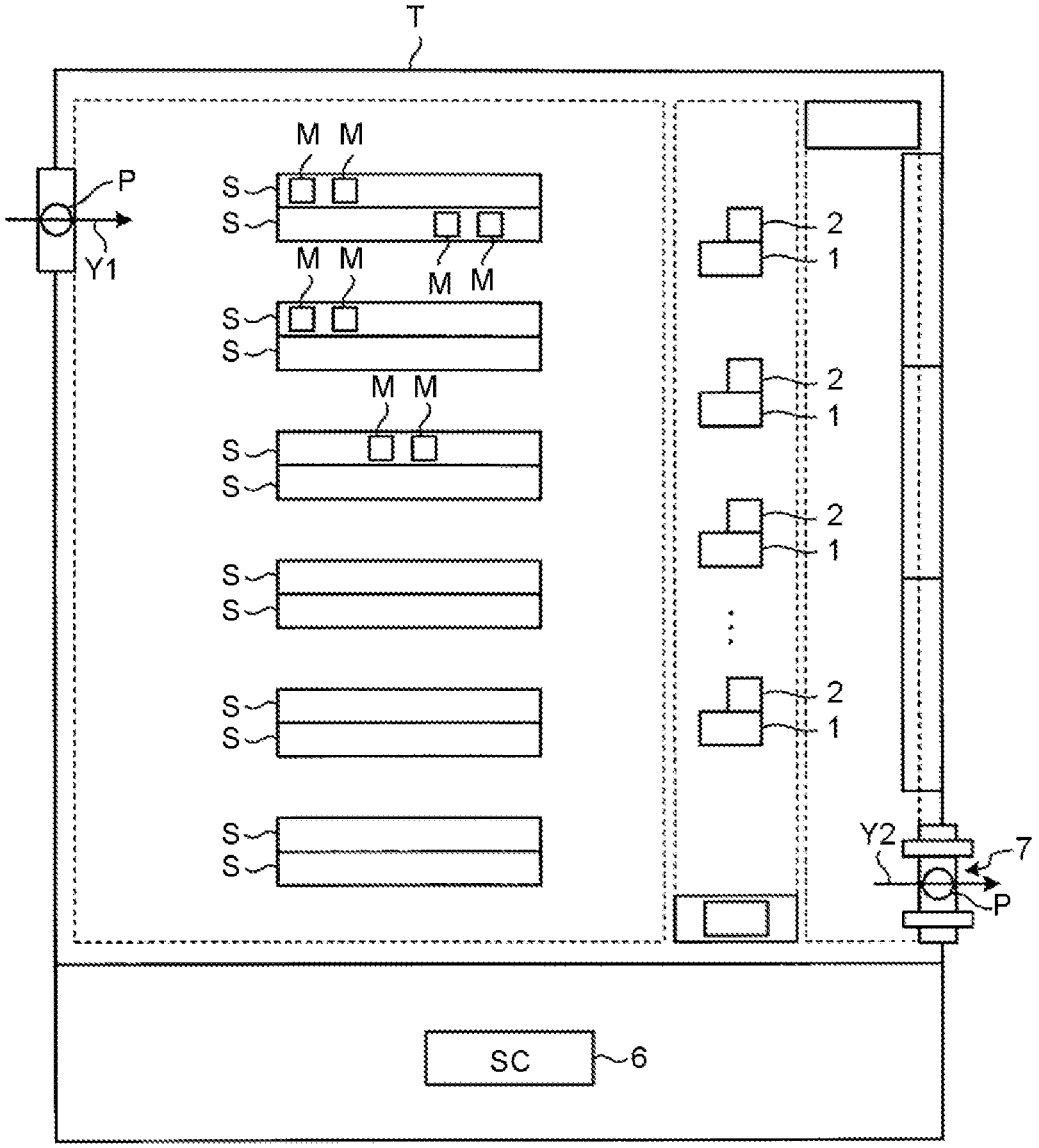
FIG. 1 is a plan view illustrating the layout of a store.

First, the layout of a store is described with reference to FIG. 1. A plurality of shelves S for displaying commodities M are arranged in parallel with one another in a store T.

Commodities M are displayed on the shelves S. A plurality of pairs of scanner apparatuses 1 and POS terminals 2 are arranged in the store T. A store computer (hereinafter referred to as an SC) 6 is arranged at the back office of the store T. Further, a gate apparatus 7 serving as the exit detection apparatus is arranged at the exit of the store T.

The scanner apparatus 1 reads a commodity code serving as commodity information contained in a barcode or a two-dimensional code and the like (hereinafter, barcode is exemplified in the present embodiment) attached to the commodity. The POS terminal 2 executes settlement processing including commodity registration processing according to the commodity code read by the scanner apparatus 1. The SC 6 collects the commodity information and the settlement information from the POS terminal 2 to manage them.

A customer P enters the store T from the entrance of the store T in a direction indicated by an arrow Y1. The customer P entering the store puts a desired commodity M in a basket from the commodities M displayed on the shelves S. Then the customer P carrying the basket in which the commodity M is put moves to a location at which the scanner apparatus 1 is installed. A shop clerk who operates the scanner apparatus 1 stands in front of the scanner apparatus 1 to read the barcode indicating a commodity code attached to the commodity M in the basket with the scanner apparatus 1 and thus the commodity code is input in the scanner apparatus 1. When the shop clerk operates a subtotal key, the scanner apparatus 1 sends the input commodity code and the like (such as a sales volume) to the POS terminal 2. The POS terminal 2 executes settlement processing and commodity registration processing based on the received commodity code and the like. The customer P puts the settled commodities M in a bag after the settlement processing is completed and goes out of an exit in a direction indicated by an arrow Y2. When leaving the store, the customer P passes through the gate apparatus 7.

Figure 2:
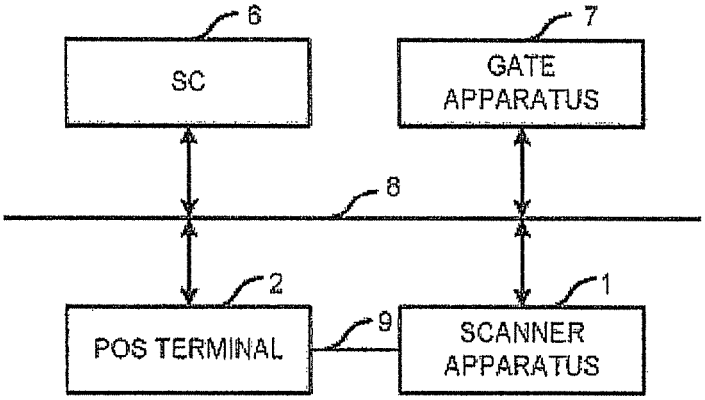
FIG. 2 is a diagram illustrating a system of one embodiment.

FIG. 2 is a diagram illustrating the system of the present embodiment. In FIG. 2, the scanner apparatus 1, the POS terminal 2, the SC 6 and the gate apparatus 7 are connected with each other through a LAN (Local Area Network) 8. The scanner apparatus 1 and the POS terminal 2 are further connected with each other through a dedicated or exclusive line 9.

Figure 3:
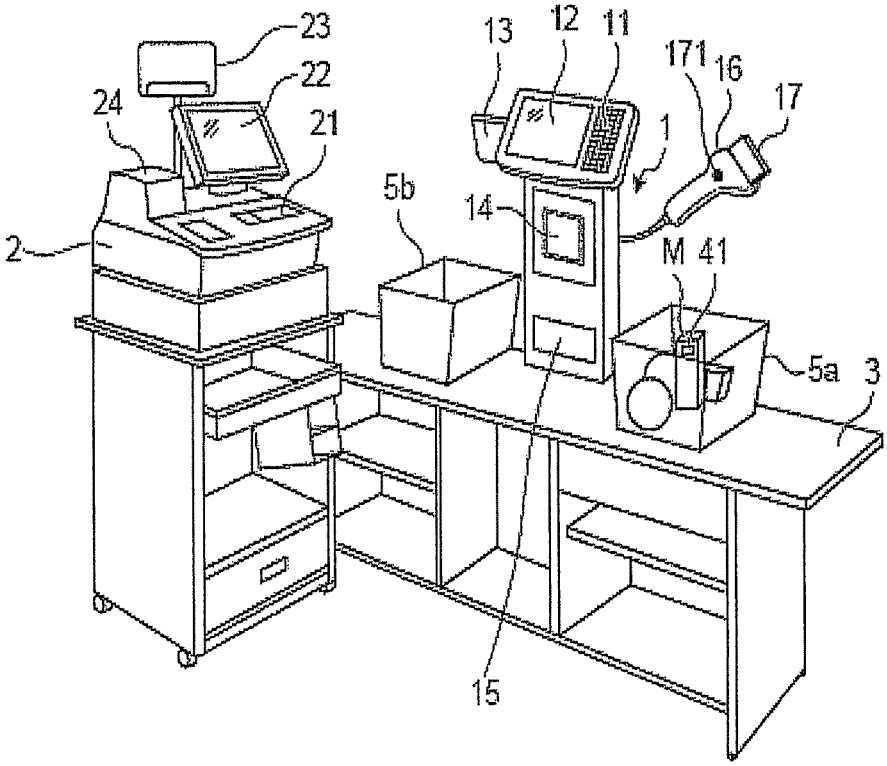
FIG. 3 is a perspective view illustrating a scanner apparatus and a POS terminal.

FIG. 3 is a perspective view illustrating a relation in arrangement between the scanner apparatus 1 and the POS terminal 2. In FIG. 3, the scanner apparatus 1 is arranged vertically in the approximate center of an elongated checkout table 3. The scanner apparatus 1 includes an operation section 11, a display for operator (shop clerk) 12, and a display for customer 13 at the upper portion thereof. The scanner apparatus 1 further includes a barcode reading section 14 at the middle portion thereof. The scanner apparatus 1 still further includes a first RFID (Radio Frequency Identification) reader/writer 15 at a portion just below the barcode reading section 14.

The operation section 11 is provided with a keyboard including numeric keys for inputting numerals, a subtotal key for executing transaction closing processing for one customer, and various function keys. The display for operator 12 is arranged in a direction facing the shop clerk who operates the scanner apparatus 1 to display information to the shop clerk. The display for customer 13 is arranged in a direction facing a customer who stands across the checkout table 3 with respect to the shop clerk to display information to the customer. The barcode reading section 14 is arranged at the front surface of the scanner apparatus 1. The barcode reading section 14 receives the light reflected from the barcode to read the barcode attached to the commodity when the shop clerk moves the commodity across the barcode reading section 14. The first RFID reader/writer 15 is arranged at the front surface of the scanner apparatus 1. The first RFID reader/writer 15 sends settlement information towards an RFID tag 41 attached to the commodity passing through the barcode reading section 14 to write the information in the RFID tag 41.

The checkout table 3 is capable of placing a basket 5*a* in which the commodity M with the RFID tag 41 is housed and a basket 5*b* for housing the commodity M the barcode of which is read by the barcode reading section 14. In FIG. 3, the basket 5*a* is placed by the customer at the right side of the scanner apparatus 1 and the basket 5*b* is placed by the shop clerk at the left side of the scanner apparatus 1.

The shop clerk takes the commodity M out from the basket 5*a* and holds the barcode of the commodity M up to or against the barcode reading section 14. In this way, the barcode is read by the barcode reading section 14. The first RFID reader/writer 15 sends information to the RFID tag 41. Then, the shop clerk puts the commodity M in the basket 5*b*.

The scanner apparatus 1 is equipped with a touch scanner 16. The touch scanner 16 is used instead of the barcode reading section 14 in a case of reading the barcode of a large commodity or a heavy commodity. The touch scanner 16 is provided with an operation button 171. When the touch scanner 16 is oriented towards the barcode and the operation button 171 is pressed, a light source arranged inside the touch scanner 16 emits light to read the barcode. The touch scanner 16 is further provided with a second RFID reader/writer 17. The second RFID reader/writer 17 sends, at the timing the light source of the touch scanner 16 emits light, information to the RFID tag 41 attached to the commodity of which the barcode is read.

The POS terminal 2 is arranged at the downstream side of the checkout table 3 in such a manner that the operation surface thereof faces the shop clerk (operator). The POS terminal 2 includes an operation section 21, a display for operator 22, a display for customer 23, a printing section 24 and the like.

The operation section 21 arranged on the upper surface of the POS terminal 2 is provided with a keyboard on which various keys including a closing key are arranged. The operation section 21 is slightly inclined towards the operator who stands in front of the POS terminal 2 to provide the operator with a comfortable operation in view of the human engineering. The display for operator 22 is oriented towards the operator to display commodity information, settlement information and the like to the operator. The display for customer 23 is oriented towards the customer who stands at the customer passage along the checkout table to display commodity information, settlement information and the like to the customer. The printing section 24 prints commodity information, settlement information and the like of the commodities subjected to the settlement processing on receipt paper and issues the paper as a receipt.

Figure 4:
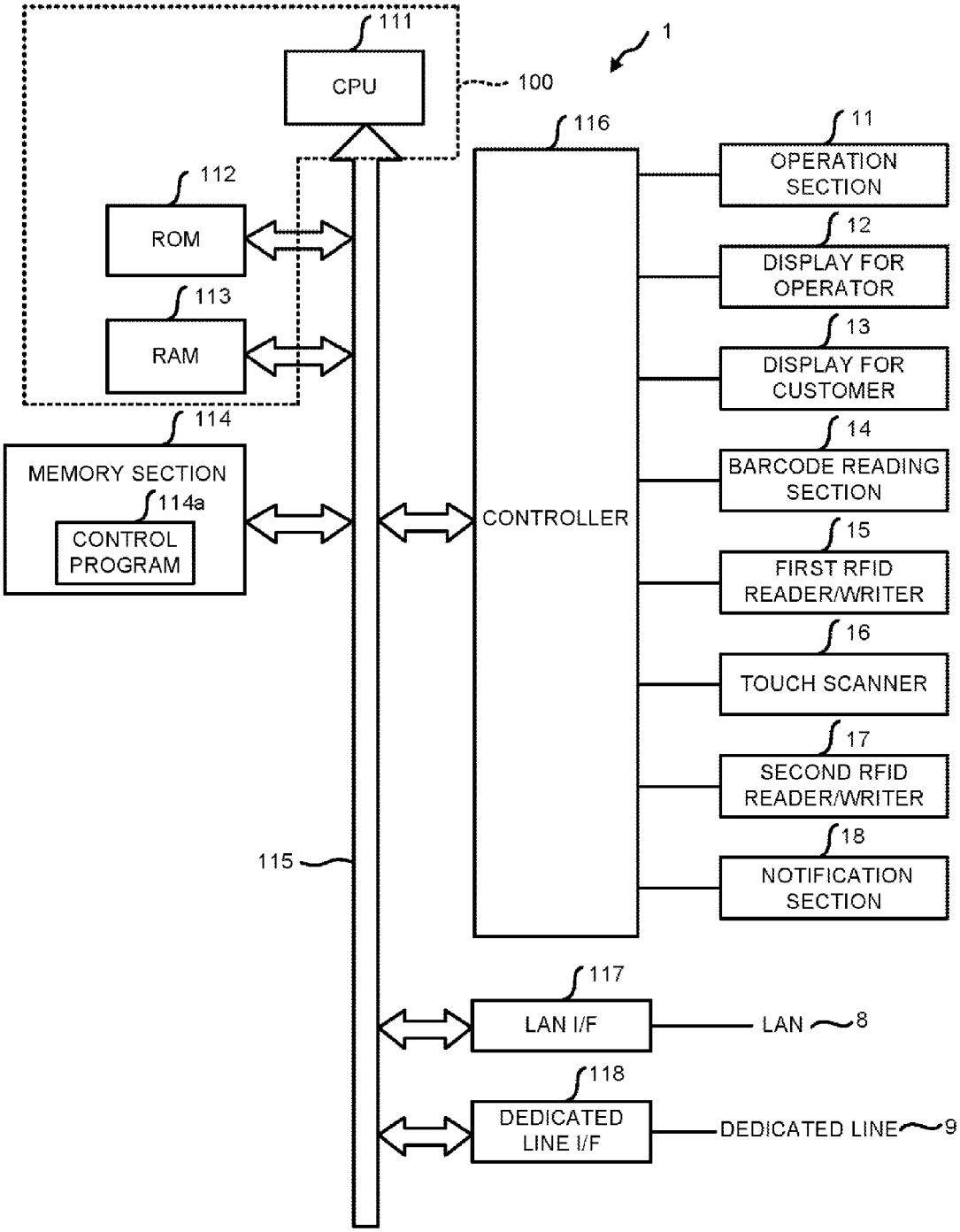
FIG. 4 is a block diagram illustrating the hardware constitution of the scanner apparatus.

Next, the hardware constitution of the scanner apparatus 1 is described with reference to the block diagram in FIG. 4. In FIG. 4, the scanner apparatus 1 includes a control section 100 for controlling each section thereof. The control section 100 is constituted with a CPU 111 for collectively controlling each section, a ROM 112 and a RAM 113 connected each other through a bus line 115 including an address bus, a data bus and the like. The control section 100 is connected with a memory section 114 and a controller 116 through the bus line 115. The CPU 111 operates according to a control program 114*a* stored in the memory section 114 and copied or decompressed on the RAM 113 when the CPU 111 executes programs 114*a*, in this way, the control section 100 carries out the later-described control processing.

The memory section 114 is constituted with an HDD (Hard Disk Drive), a nonvolatile memory such as a flash memory and the like in which the stored information is maintained even if the power source is cut off. The memory section 114 stores programs including the control program 114*a*.

The controller 116 is connected with the operation section 11, the display for operator 12, the display for customer 13, the barcode reading section 14, the first RFID reader/writer 15, the touch scanner 16, the second RFID reader/writer 17 and the notification section 18. The controller 116 controls the operation section 11, the display for operator 12, the display for customer 13, the barcode reading section 14, the first RFID reader/writer 15, the touch scanner 16, the second RFID reader/writer 17 and the notification section 18 according to various instructions from the control section 100.

The notification section 18 activates a buzzer to notify the shop clerk or operator of operation information with different tones or sounds in different cases in which the commodity code is read correctly, the commodity code is not read successfully, information is written in the RFID tag 41 correctly by the first RFID reader/writer 15 or the second RFID reader/writer 17 and the like.

The control section 100 is further connected with a LAN I/F (interface) 117 through the bus line 115. The LAN I/F 117 is connected with, for example, the POS terminal 2, the gate apparatus 7 and the SC 6 arranged at the back office of the store T through a LAN 8. The POS terminal 2 sends information of the sold commodity to the SC 6 through the LAN 8. The SC 6 manages the received commodity information.

The control section 100 is still further connected with a dedicated line I/F (interface) 118 through the bus line 115. The dedicated line I/F 118 is connected with the POS terminal 2 through the dedicated line 9.

Figure 5:
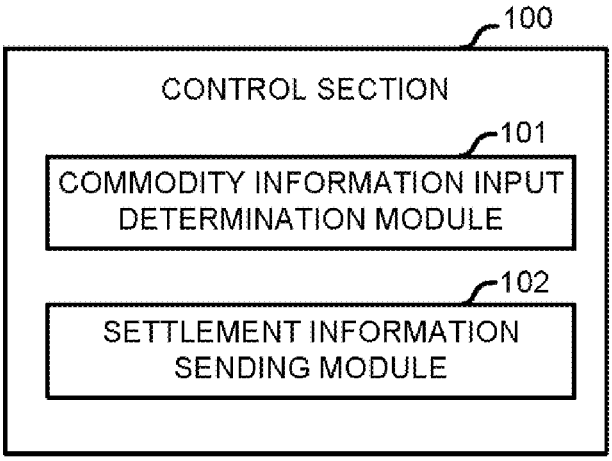
FIG. 5 is a functional block diagram illustrating the functional constitution of the scanner apparatus.

Next, the control processing of the scanner apparatus 1 according to the present embodiment is described with reference to FIG. 5 and FIG. 6. FIG. 5 is a functional block diagram illustrating the functional constitution of the scanner apparatus 1. The control section 100 of the scanner apparatus realizes functions of a commodity information input determination module 101 and a settlement information sending module 102 by the CPU 111 which operates according to programs such as a control program 114*a* stored in the memory section 114.

The commodity information input determination module 101 has a function of determining whether or not commodity information for specifying a commodity is input.

The settlement information sending module 102 has a function of sending settlement information indicating that the commodity is settled to the RFID tag 41, capable of reading/writing information, which is attached to the commodity if the commodity information input determination module 101 determines that the commodity information is input.

Figure 6:
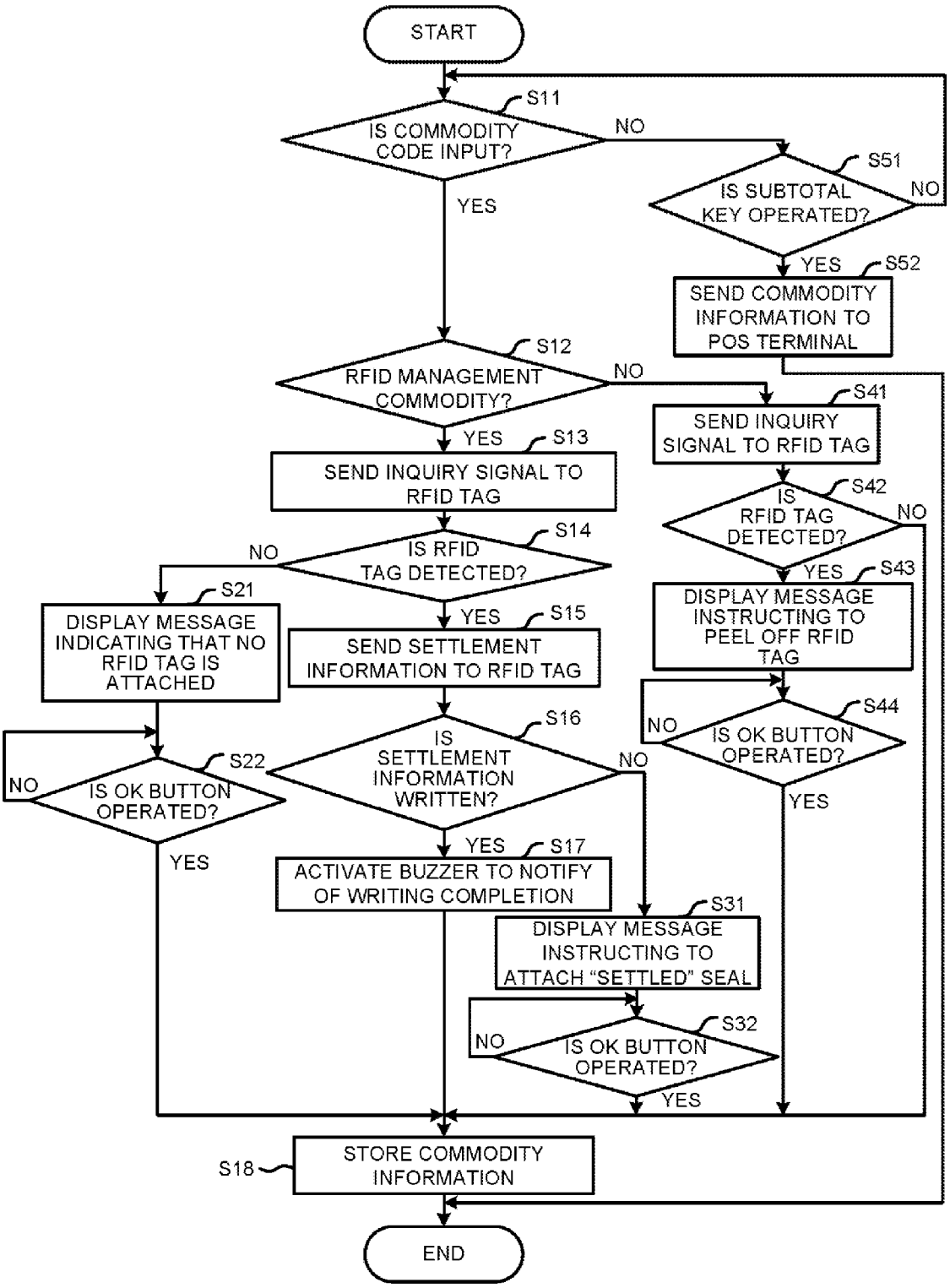
FIG. 6 is a flowchart illustrating a control processing of the scanner apparatus.

FIG. 6 is a flowchart illustrating a control processing of the scanner apparatus 1. In FIG. 6, the control section 100 determines whether or not a commodity code is input if the barcode is read through the barcode reading section 14 or the touch scanner 16 (ACT S11). If it is determined that the commodity code is input (YES in ACT S11), the control section 100 further determines whether or not the commodity of which the commodity code is input is a commodity managed with the RFID tag 41 by reference to a commodity master file 214*b* (refer to FIG. 9) described later which is stored in the POS terminal 2 (ACT S12). The commodity master file 214*b* may be stored in the SC 6. The commodity managed with the RFID tag 41 refers to a commodity, subject to anti-theft management by the gate apparatus 7, to which the RFID tag 41 is attached. Generally, commodities valuable in price and commodities easy to be stolen are preselected as a managed commodity; while commodities inexpensive, commodities difficult to move and commodities to which the RFID tag 41 is difficult to be attached are not selected.

If it is determined that the commodity of which the commodity code is input is a commodity managed with the RFID tag 41 (YES in ACT S12), the control section 100 drives the first RFID reader/writer 15 or the second RFID reader/writer 17 to send a signal to the RFID tag 41 to inquire whether or not the RFID tag 41 is attached to the commodity of which the commodity code is input (ACT S13). A reply signal is output from the RFID tag 41 if the RFID tag 41 is attached to the commodity, or no reply signal is output or present if the RFID tag 41 is not attached to the commodity.

The control section 100 detects the RFID tag 41 by receiving the reply signal from the RFID tag 41. The control section 100 determines whether or not the RFID tag 41 is detected (ACT S14). If it is determined that the RFID tag 41 is detected (YES in ACT S14), the control section 100 sends settlement information indicating that the settlement of the commodity to which the RFID tag 41 is attached is completed, designating an address to the RFID tag 41 so that a company code stored in a company code section 412 is rewritten with the settlement information indicating completion of the settlement (ACT S15).

Figure 7:
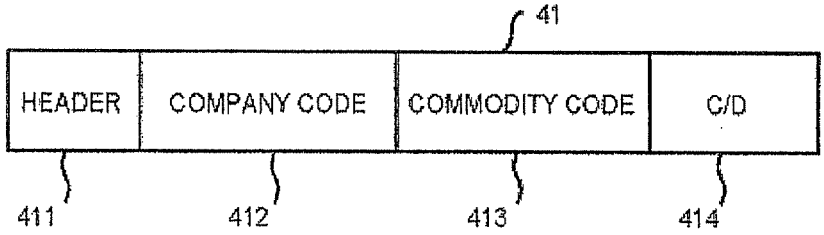
FIG. 7 is a schematic view illustrating a memory of an RFID.

Now, the memory structure of the RFID tag 41 is described with reference to FIG. 7. In FIG. 7, the RFID tag 41 has storage areas of a header section 411, the company code section 412, a commodity code section 413 and a C/D (Check Digit) section 414. The header section 411 stores a code for identifying an organization that issues the number of a unique identifier. The company code section 412 stores a company code for specifying a company or a store that uses the RFID tag 41. The commodity code section 413 stores the commodity code for specifying a commodity to which the RFID tag 41 is attached. The C/D section 414 stores a check code for checking whether or not information is stored in the RFID tag 41 correctly.

In the present embodiment, in the store T or when the RFID tag 41 is conveyed into the store T, a predetermined company code for specifying the store T is stored in the company code section 412 of the RFID tag 41. Thus, the company code for specifying the store T is stored in the RFID tag 41 attached to the commodity in the store T.

The RFID tag 41 writes or saves the received settlement information in the company code section 412. After the settlement information is written, writing completion information is sent to the first RFID reader/writer 15 or the second RFID reader/writer 17.

Now return to the description in FIG. 6. The control section 100 determines whether or not the writing completion information is received from the RFID tag 41 (ACT S16). If it is determined that the writing completion information is received (YES in ACT S16), the control section 100 enables the notification section 18 to activate the buzzer to notify the shop clerk and the customer P that the settlement information is written in the RFID tag 41 (ACT S17).

Then the commodity code of the commodity is stored in a given area of the RAM 113 (ACT S18).

On the contrary, if it is determined that the RFID tag 41 is not detected in ACT S14 (NO in ACT S14), the control section 100 displays a message indicating that no RFID tag 41 is attached to the commodity or there is a possibility that the RFID tag 41 is peeled off on the display for operator 12 and the display for customer (ACT S21). In this case, the shop clerk (operator) confirms that no RFID tag 41 is attached to the commodity, and operates an OK key (not shown), for example, arranged on the operation section 11, in this way, the commodity can also be registered even though no RFID tag 41 is attached.

The control section 100 determines whether or not the OK key is operated (ACT S22). The control section 100 waits for until the OK key is operated (NO in ACT S22), and if it is determined that the OK key is operated (YES in ACT S22), the control section 100 executes the processing in ACT S18. The commodity code of the commodity for which the OK key is operated in ACT S22 is stored and the stored commodity code is used as management information of the commodity to which no RFID tag 41 is attached, thereafter.

On the other hand, if it is determined that the writing completion information is not received from the RFID tag 41 in ACT S16 (NO in ACT S16), there is a possibility that the RFID tag 41 is out of order. Thus, the control section 100 displays a message instructing the shop clerk to attach a "settled" seal to the RFID tag 41 (ACT S31) on the display for operator 12. The shop clerk who reads the message sticks a seal covering the whole RFID tag 41 to the commodity. Such a seal has a function of shielding the RFID tag 41 from electric wave. The RFID tag 41 to which the seal is attached does not make a response to the signal from an external device such as the gate apparatus 7 and the like. Then the control section 100 determines whether or not the OK key is operated (ACT S32). The control section 100 waits for until the OK key is operated (NO in ACT S32). If it is determined that the OK key is operated (YES in ACT S32), the control section 100 executes the processing in ACT S18.

If it is determined that the commodity of which the commodity code is input is not the commodity managed with the RFID tag 41 in ACT S12 (NO in ACT S12), the control section 100 activates the first RFID reader/writer 15 or the second RFID reader/writer 17. Then, the control section 100 sends a signal to the RFID tag 41 to inquire whether or not the RFID tag 41 is attached to the commodity of which the commodity code is input (ACT S41). A reply signal is output from the RFID tag 41 if the RFID tag 41 is attached to the commodity, or no reply signal is output if the RFID tag 41 is not attached to the commodity.

The control section 100 determines that the RFID tag 41 is detected if the reply signal is received from the RFID tag 41 as described above. The control section 100 determines whether or not the RFID tag 41 is detected (ACT S42). If it is determined that the RFID tag 41 is detected (YES in ACT S42), there is a possibility that the RFID tag 41 is attached to the commodity by mistake because it is determined in ACT 12 that the commodity is not one managed with the RFID tag 41. Thus, if it is determined that the RFID tag 41 is detected, the control section 100 displays a message instructing the shop clerk to peel or remove the RFID tag 41 from the commodity on the display for operator 12 (ACT S43).

The shop clerk who reads the message peels the RFID tag 41 from the commodity and operates the OK key. The control section 100 determines whether or not the OK key is operated (ACT S44). The control section 100 waits for until the OK key is operated (NO in ACT S44). If it is determined that the OK key is operated (YES in ACT S44), the control section 100 executes the processing in ACT S18. On the other hand, if it is determined that the RFID tag 41 is not detected in ACT S42 (NO in ACT S42), the control section 100 also executes the processing in ACT S18.

If it is determined that no commodity code is input in ACT S11 (NO in ACT S11), the control section 100 determines whether or not the subtotal key (not shown) arranged on the operation section 11 is operated (ACT S51). if it is determined that the subtotal key is operated (YES in ACT S51), the control section 100 sends all the commodity information stored in the memory in ACT S18 to the POS terminal 2 through the dedicated line 9 (ACT S52). If it is determined that the subtotal key is not operated (NO in ACT S51), the control section 100 returns to ACT S11 and waits for until input operation is executed.

In accordance with such an embodiment described above, the control section 100 of the scanner apparatus 1 sends the settlement information indicating completion of the settlement to the RFID tag 41 attached to the commodity of which the commodity code is input. In this way, the settlement information is stored in the RFID tag 41 such that it is overwritten on the company code in the memory of the RFID tag 41.

Figure 8:
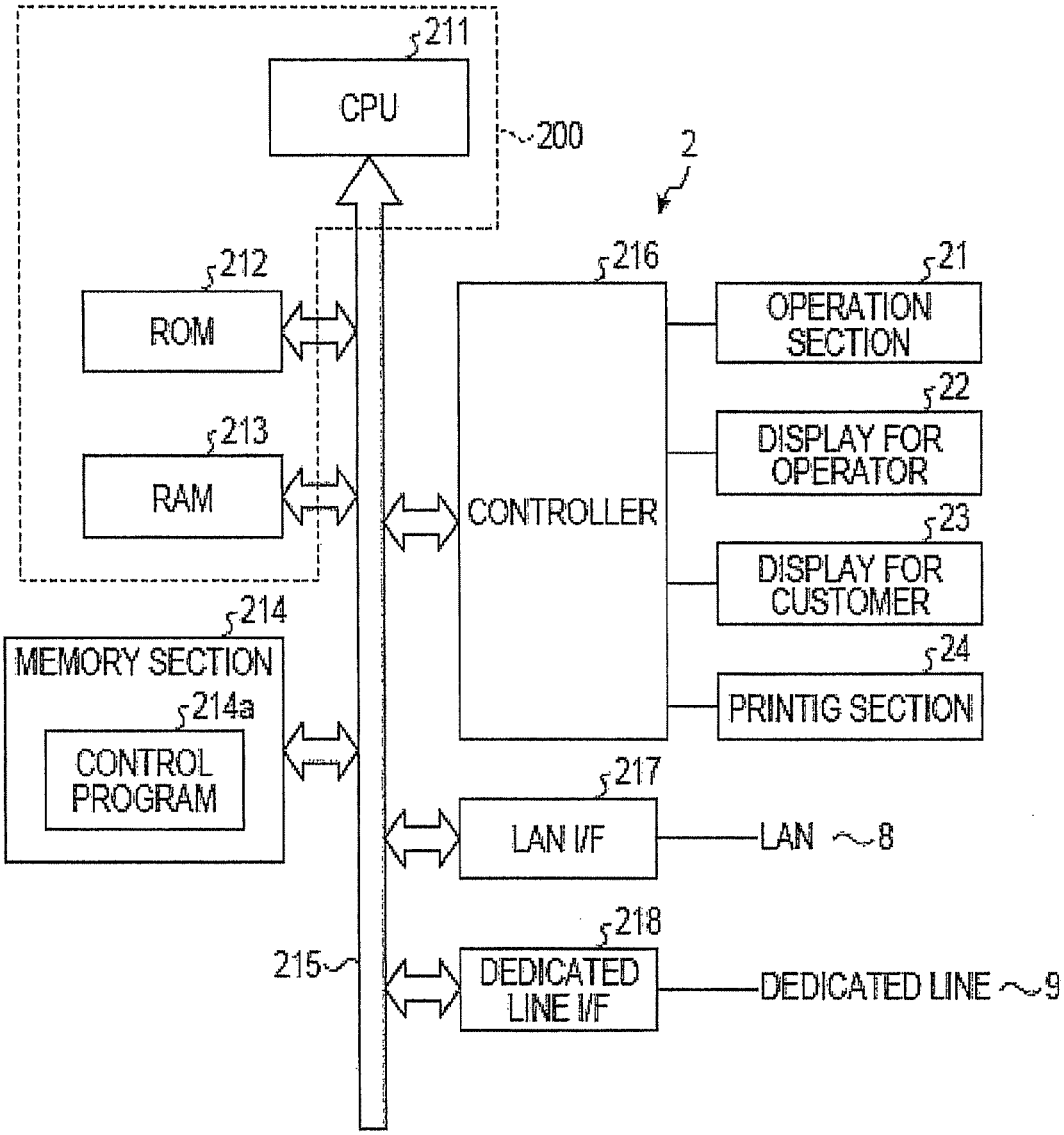
FIG. 8 is a block diagram illustrating the hardware constitution of the POS terminal.

Next, the hardware constitution of the POS terminal 2 is described with reference to FIG. 8 and FIG. 9. FIG. 8 is a block diagram illustrating the hardware constitution of the POS terminal 2. In FIG. 8, the POS terminal 2 includes a control section 200 for controlling each section thereof. The control section 200 is constituted by connecting a CPU 211 for collectively controlling each section with a ROM 212 and a RAM 213 through a bus line 215 including an address bus, a data bus and the like. The control section 200 is connected with a memory section 214 and a controller 216 through the bus line 215. The CPU 211 operates according to a control program 214*a* that is stored in the memory section 214 and copied or decompressed on the RAM 213, in this way, the control section 200 executes the later-described control processing.

The memory section 214 is constituted with an HDD, a nonvolatile memory such as a flash memory and the like in which the stored information is maintained even if the power source is cut off. The memory section 214 stores programs including the control program 214*a*.

The controller 216 is connected with the operation section 21, the display for operator 22, the display for customer 23 and the printing section 24. The controller 216 controls the operation section 21, the display for operator 22, the display for customer 23 and the printing section 24 according to various instructions from the control section 200.

The control section 200 is further connected with a LAN I/F (interface) 217 through the bus line 215. The LAN I/F 217 is connected with, for example, the scanner apparatus 1, the gate apparatus 7 and the SC 6 arranged at the back office of the store T through the LAN 8. Each POS terminal 2 sends information of the sold commodity to the SC 6 through the LAN 8. The SC 6 manages the received commodity information.

The control section 200 is connected with a dedicated line I/F 218 through the bus line 215. The dedicated line I/F 218 is connected with the scanner apparatus 1 through the dedicated line 9.

Figures 9, 10:
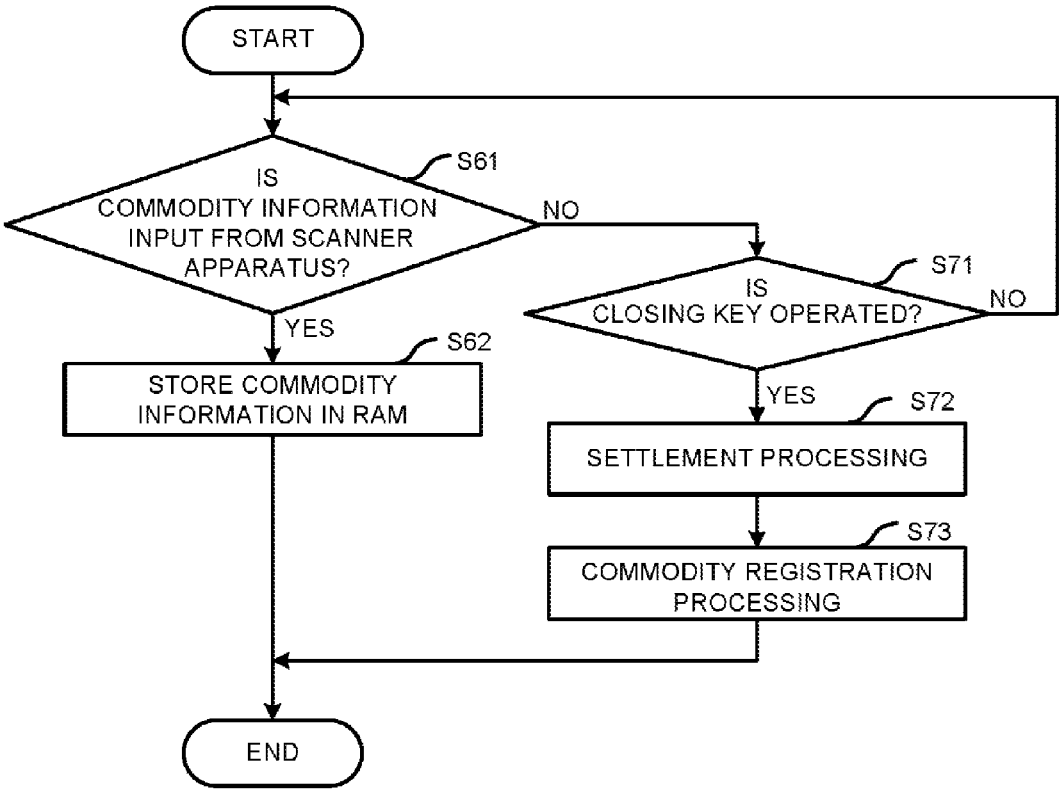
FIG. 9 is a schematic view illustrating a commodity master file of the POS terminal.
FIG. 10 is a flowchart illustrating a control processing of the POS terminal.

FIG. 9 is a schematic view illustrating the commodity master file 214*b* stored in the memory section 214. In FIG. 9, the commodity master file 214*b* includes a commodity code section 214*b*1, a commodity name section 214*b*2, a price section 214*b*3, an attribution information section 214*b*4, an RFID managing commodity section 214*b*5.

The commodity code section 214*b*1 stores a commodity code for specifying a commodity. The commodity name section 214*b*2 stores a commodity name of the commodity specified with the commodity code. The price section 214*b*3 stores price of the commodity specified with the commodity code. The attribution information section 214*b*4 stores other information of the commodity specified with the commodity code.

The RFID managing commodity section 214*b*5 stores information indicating whether or not the commodity specified with the commodity code is a commodity managed with the RFID tag 41. Specifically, a flag "1" is stored in the RFID managing commodity section 214*b*5 in a case in which the commodity is managed with the RFID tag 41. A flag "0" is stored in the RFID managing commodity section 214*b*5 in a case in which the commodity is not managed with the RFID tag 41. In the example shown in FIG. 9, the flag "1" is stored in the RFID managing commodity section 214*b*5 for the commodity having a commodity code "001" and the commodity having a commodity code "002". Thus, the commodity having a commodity code "001" and the commodity having a commodity code "002" are managed with the RFID tag 41. On the other hand, the flag "0" is stored in the RFID managing commodity section 214*b*5 for the commodity having a commodity code "003". Thus, the commodity having a commodity code "003" is not managed with the RFID tag 41.

Next, the control processing of the POS terminal 2 is described with reference to the flowchart in FIG. 10. In FIG. 10, the control section 200 determines whether or not the commodity information relating to one transaction is input from the scanner apparatus 1 through the dedicated line 9 (ACT S61). If it is determined that the commodity information is input (YES in ACT S61), the control section 200 stores the input commodity information in the RAM 213 (ACT S62).

However, if it is determined that the commodity information is not input (NO in ACT S61), the control section 200 further determines whether or not the closing key (not shown) arranged on the operation section 21 is operated (ACT S71). If it is determined that the closing key is operated (YES in ACT S71), the control section 200 executes a settlement processing of calculating a total amount and a change amount based on the commodity information stored in the RAM 213 in ACT S62 (ACT S72). Then the control section 200 sends the commodity information of the commodities of which the settlement processing is carried out and the settlement information to the SC 6 to execute a commodity registration processing (ACT S73). On the contrary, if it is determined that the closing key is not operated (NO in ACT S71), the control section 200 returns to ACT S61 and waits for until input operation is executed.

Figure 11:
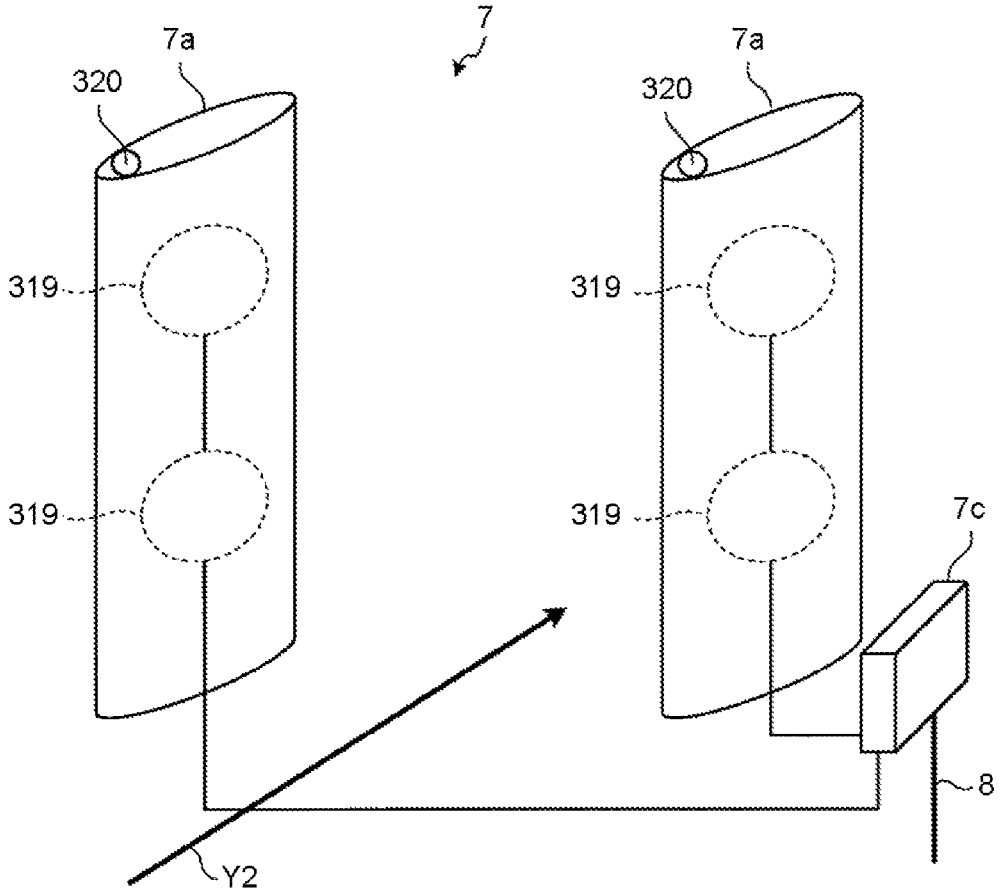
FIG. 11 is a perspective view illustrating a gate apparatus.

Next, constitution and control processing of the gate apparatus 7 is described with reference to FIG. 11-FIG. 14. FIG. 11 is a perspective view illustrating the constitution of the gate apparatus 7. In FIG. 11, the gate apparatus 7 includes a pair of gates 7*a* and a control device 7*c*. The pair of gates 7*a* is vertically arranged parallel to each other with a space therebetween along the exit direction indicated by an arrow Y2 at the inside of the exit of the store T. The pair of gates 7*a* includes RFID reader/writers 319 inside thereof, respectively. Human sensors 320 are respectively arranged inside of one upper end part of the upstream side of each gate 7*a* in the exit direction Y2. When a person approaches, the human sensor 320 senses the person and outputs a signal. In the present embodiment, the human sensor 320 senses the customer P who is passing through the gates 7*a* in a direction indicated by the arrow Y2 to the exit of the store T. When the signal indicating that a person approaches the space between the gates 7*a* is input from the human sensor 320, the control device 7*c* controls the RFID reader/writer 319 to monitor the REID tag 41 attached to the commodity passing through the gates 7*a*.

Figure 12:
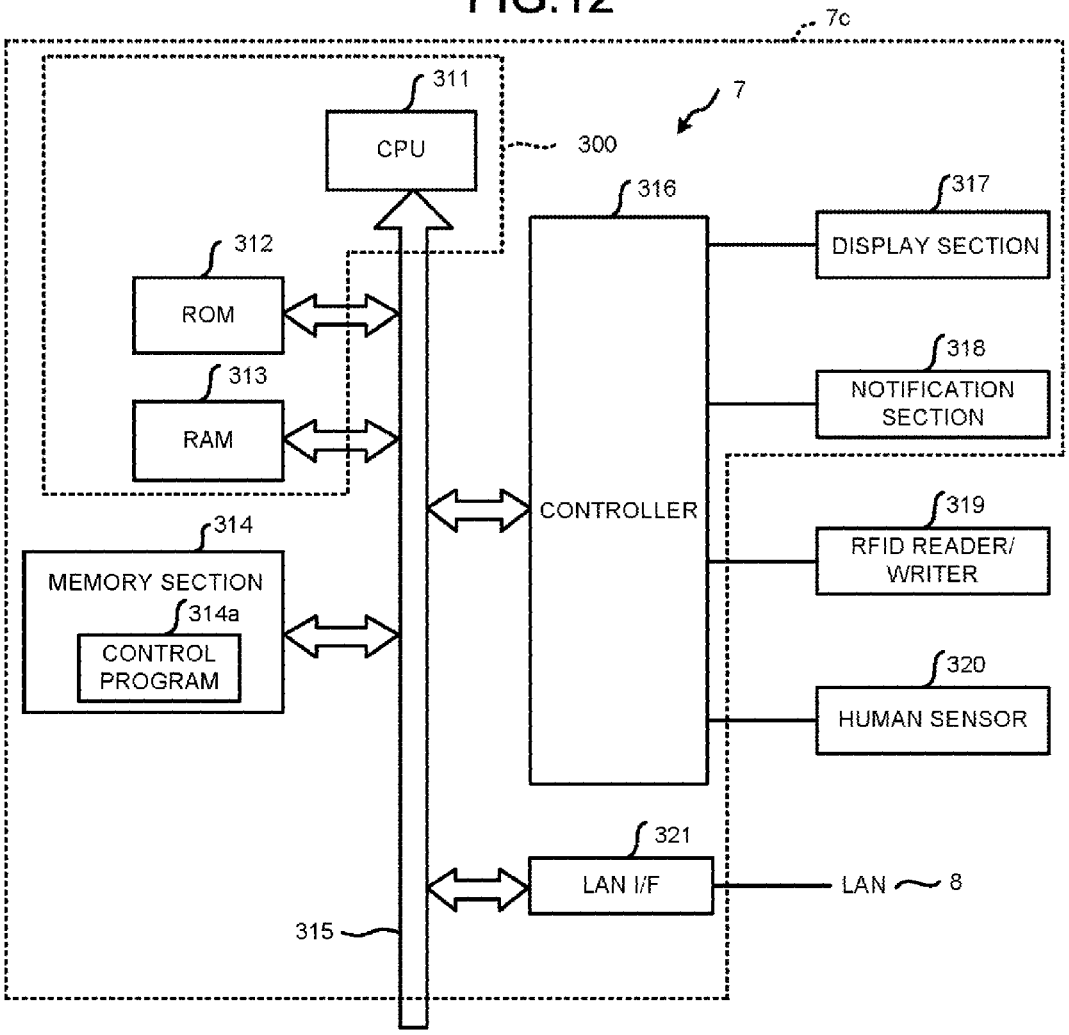
FIG. 12 is a block diagram illustrating the hardware constitution of the gate apparatus.

FIG. 12 is a block diagram illustrating the hardware constitution of the gate apparatus 7. In FIG. 12, the gate apparatus 7 includes a control section 300 for controlling each section of the gate apparatus 7. The control section 300 is constituted by connecting a CPU 311 for collectively controlling each section with a ROM 312 and a RAM 313 through a bus line 315 including an address bus, a data bus and the like. The control section 300 is connected with a memory section 314 and a controller 316 through the bus line 315. The CPU 311 operates according to a control program 314*a* that is stored in the memory section 314 and copied or decompressed on the RAM 313 when it is executed, in this way, the control section 300 executes the later-described control processing.

The memory section 314 is constituted by an HDD, a nonvolatile memory such as a flash memory and the like in which the stored information is maintained even if the power source is cut off. The memory section 314 stores programs including the control program 314*a*.

The controller 316 is connected with a display section 317, a notification section 318, the RFID reader/writer 319 and the human sensor 320. The controller 316 controls the display section 317, the notification section 318, the RFID reader/writer 319 and the human sensor 320 according to various instructions from the control section 300.

The control section 300 is further connected with a LAN I/F 321 through the bus line 315. The LAN I/F 321 is connected with, for example, the scanner apparatus 1, the POS terminal 2 and the Sc 6 arranged at the back office of the store T through the LAN 8. The control section 300, the memory section 314, the controller 316, the display section 317, the notification section 318, the LAN I/F 321 and the like constitute the control device 7*c*.

Figure 13:
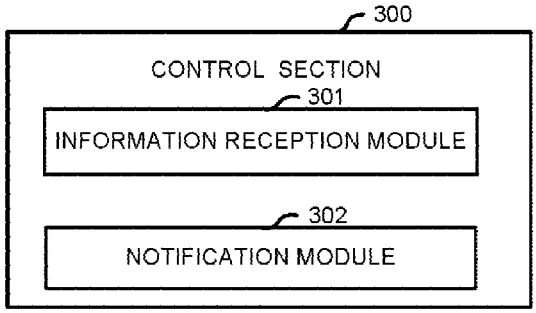
FIG. 13 is a functional block diagram illustrating the functional constitution of the gate apparatus.

Next, the control processing of the gate apparatus 7 serving as the exit detection apparatus according to the present embodiment is described with reference to FIG. 13 and FIG. 14. FIG. 13 is a functional block diagram illustrating the functional constitution of the gate apparatus 7. The CPU 311 of the control section 300 operates according to the programs such as the control program 314*a* stored in the memory section 314, in this way, the control section 300 of the gate apparatus 7 realizes the functions of an information reception module 301 and a notification module 302.

The information reception module 301 has a function of receiving information from the RFID tag 41 from or into which information can be read or written.

In a case in which the control section determines that the information received by the information reception module 301 does not include the settlement information indicating that the commodity is settled, the notification module 302 has a function of notifying the operator of the message that the commodity is not settled.

Figure 14:
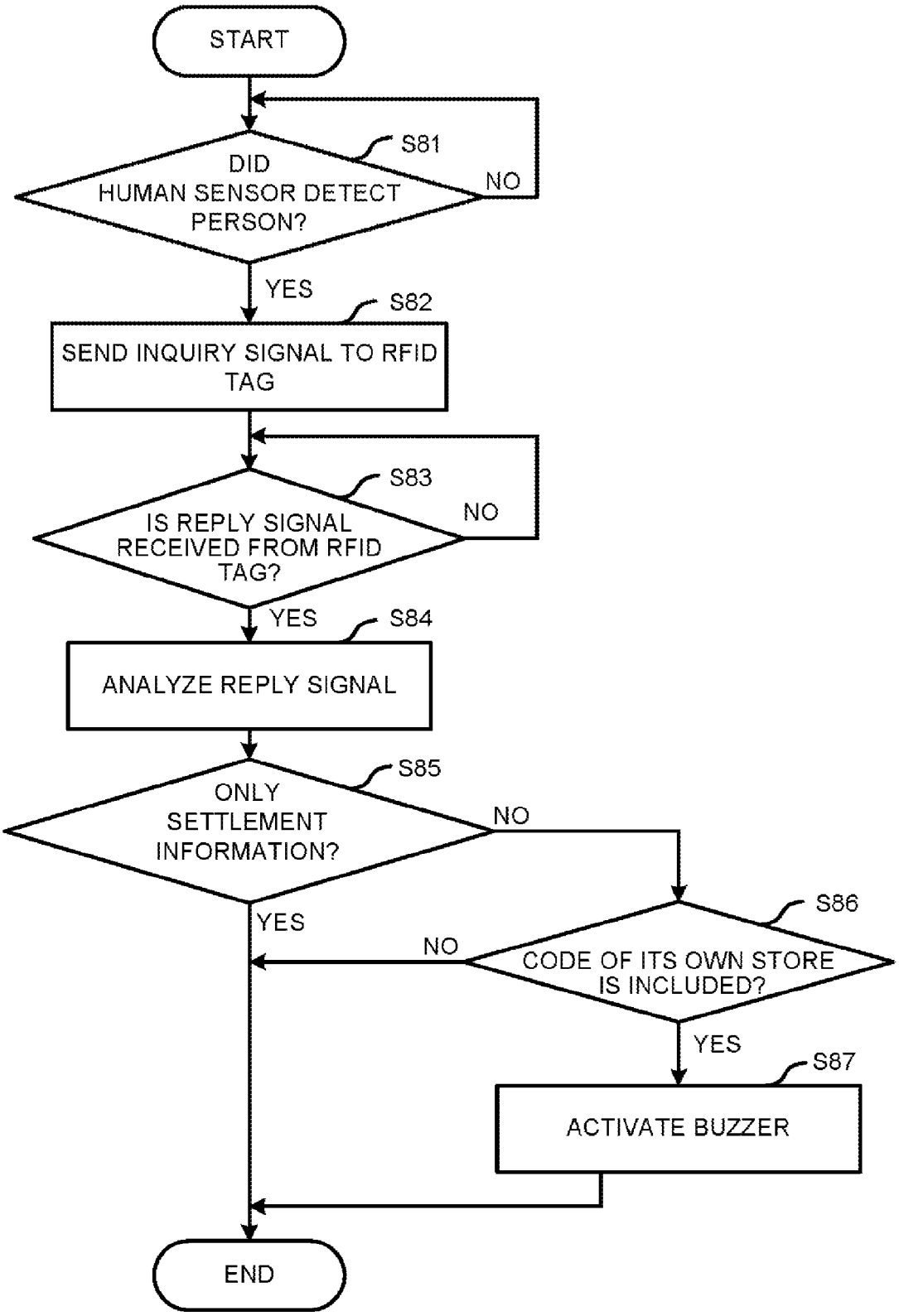
FIG. 14 is a flowchart illustrating a control processing of the gate apparatus.

FIG. 14 is a flowchart illustrating the control processing of the gate apparatus 7. In FIG. 14, the control section 300 determines whether or not the human sensor 320 detects a person who is passing through the gates 7*a* towards the exit (ACT S81). The control section 300 waits for until a person who is passing through the gates 7*a* is detected (NO in ACT S81). If it is determined that the human sensor 320 detects a person who is passing through the gates 7*a* (YES in ACT S81), the control section 300 sends a signal for inquiring the stored information of the RFID tag 41 from the RFID reader/writer 319 (ACT S82).

Upon receiving the signal sent from the RFID reader/writer 319, the RFID tag 41 passing through the gates 7*a* sends information stored therein.

The control section 300 determines whether or not the information is received from the RFID tag 41 (ACT S83). The control section 300 waits for until it receives the information from the RFID tag 41 (NO in ACT S83). If it is determined that the information is received from the RFID tag 41 (YES in ACT S83), the control section 300 analyzes the information received from the RFID tag 41 (ACT S84). The control section 300 analyzes whether or not information stored in the company code section 412 within the received information indicates that commodities are all settled. The control section 300 also analyzes whether or not information indicating the company code of its own store is included.

Then the control section 300 determines whether or not the received information only includes the settlement information indicating that commodities are already settled (ACT S85). Specifically, if it is determined that the received information does not include a code indicating the company code, the control section 300 determines that all the information only includes the settlement information indicating that commodities are settled. If it is determined that all the received information is the settlement information indicating that commodities are settled (YES in ACT S85), the control section 300 terminates the processing.

On the other hand, if it is determined that all the received information includes not only the settlement information but also other information (NO in ACT S85), the control section 300 further determines whether or not the received information includes a company code indicating its own store (ACT S86). The company code of its own store is stored in the memory section 314 of the gate apparatus 7, and thus the control section 300 compares the received company code with the company code stored in the memory section 314 to determine whether or not the received company code is the company code of its own store.

If it is determined that the received information does not include the company code indicating its own store (NO in ACT S86), the control section 300 terminates the processing. On the other hand, if it is determined that the received information includes the company code indicating its own store (YES in ACT S86), the control section 300 issues a buzzer sound from the notification section 318 (ACT S87).

In a case in which the received information includes not the company code of its own store but a company code of other store, "NO" is taken in ACT S86 and the control section 300 does not issue a buzzer sound.

It is exemplified in the present embodiment that the store where the apparatuses are arranged is described as its own store, while stores other than the store where the apparatuses are arranged are described as another store. However, the present invention is not limited to this. For example, affiliated stores or chain stores may be set as its own store and stores other than the affiliated stores may be set as another store. Alternatively, the store of its own company may be set as its own store, while the store of another company may be set as another store, and in this case, the company code indicating its own company is stored in the company code section 412 in advance.

If the settlement information indicating that commodities are settled or a company code of another store is received from all the RFID tags 41 passing through the gates 7*a*, the gate apparatus 7 does not activate the buzzer and thus a notification is not given from the notification section 318. However, if the company code of its own store is received from the RFID tags 41 passing through the gates 7*a*, the gate apparatus 7 activates the buzzer to give a notification from the notification section 318. In this way, the gate apparatus 7 activates the buzzer for the unsettled commodity, while it does not activate the buzzer for the settled commodity. Further, the gate apparatus 7 does not activate the buzzer for the commodity brought into the store by a customer from another store.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

For example, it is exemplified in the present embodiment that the control section 300 determines whether or not information received from the RFID tag 41 includes the settlement information indicating that settlement is completed, and the company code of its own store, however, the control section 300 may also determine whether or not information stored in the company code section 412 is the settlement completion information or the company code of its own store. In this case, if information stored in the company code section 412 is the settlement completion information, the control section 300 determines that the settlement information is included. If information stored in the company code section 412 is not the settlement completion information, the control section 300 determines that the settlement information is not included. Further, if information stored in the company code section 412 is the company code indicating its own store, the control section 300 determines that information of its own store is included. If information stored in the company code section 412 is not the company code indicating its own store, the control section 300 determines that information of its own store is not included.

In the present embodiment, a gate apparatus provided with a pair of gates 7*a* is exemplified as the exit detection apparatus, however, one of the gates 7*a* may only be arranged at one side. Further, the gate 7*a* may be hung at the ceiling nearby the exit. In addition to the gate apparatus, the exit detection apparatus may also be, for example, such a constitution consisting of a mat, laid on the floor nearby the exit, in which the RFID reader/writer 319 including an antenna is embedded.

Figure 15:
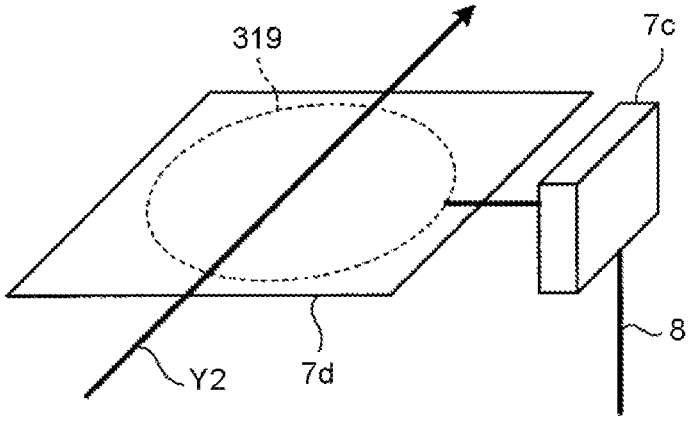
FIG. 15 is a perspective view illustrating a mat serving as an exit detection apparatus.

FIG. 15 shows an example in which a mat 7*d* is used as the exit detection apparatus. The control device 7*c*, the LAN 8 and the RFID reader/writer 319 shown in FIG. 15 are structurally identical to those shown in FIG. 11 and FIG. 12, and thus, the descriptions thoseof are not repeated.

In FIG. 15, the mat 7*d* is formed in a square shape, for example, and is made of carpet fabric or rubber material. The mat 7*d* is provided with the RFID reader/writer 319 embedded therein. The mat 7*d* is laid on the floor nearby the exit of the store T. The control section 300 of the control device 7*c* executes the same control as the control in FIG. 13 on the RFID tag 41 passing across the mat 7*d*. A case in which the customer P is passing across the mat 7*d* to exit from the store T in the direction indicated by the arrow Y2 is given as a specific example. If the RFID reader/writer 319 receives the company code of its own store, the notification section 318 activates the buzzer to give a notification. On the other hand, if the RFID reader/writer 319 receives the settlement completion information from all the RFIDs 41 passing across the mat 7*d*, the notification section 318 arranged inside the control device 7*c* does not activate the buzzer and thus a notification is not given. Further, if the RFID reader/writer 319 receives the company code of other store from all the RFID tags 41 passing across the mat 7*d*, the notification section 318 arranged inside the control device 7*c* does not activate the buzzer and thus a notification is not given.

In this way, the control section 300 activates the buzzer for the unsettled commodity passing across the mat 7*d*. On the other hand, the control section 300 does not activate the buzzer for the settled commodity passing across the mat 7*d*. Further, the control section 300 does not activate the buzzer for the commodity, passing across the mat 7*d*, that is brought into the store by a customer from other store. Moreover, the mat 7*d* may be provided with no human sensor 320. In this case, the control section 300 does not execute the control in ACT S81.

In the present embodiment, the buzzer is activated to give a notification; however, a notification may be given through another method such as turning on a light, instead of activating the buzzer.

The programs executed in the commodity sales data processing apparatus of the present embodiment are recorded in a computer-readable recording medium such as CD-ROM, flexible disk (FD), CD-R, DVD (Digital Versatile Disk) and the like in the form of installable or executable file.

Further, the programs executed in the commodity sales data processing apparatus of the present embodiment may be stored in a computer connected with a network such as the Internet, and downloaded via the network. Further, the program executed in the commodity sales data processing apparatus of the present embodiment may also be provided or distributed via a network such as the Internet.

The programs executed in the commodity sales data processing apparatus of the present embodiment may also be installed in the ROM in advance.

What is claimed is:

1. A commodity information input apparatus, comprising:

an input module configured to receive an input of commodity information for specifying a commodity;

a determination module configured to determine, from the commodity information received by the input module, whether the commodity specified with the commodity information is a managed commodity that is subject to anti-theft management via a Radio Frequency Identification (RFID) tag attached to the commodity; and a settlement information sending module configured to send, to the RFID tag attached to the commodity, settlement information indicating that settlement of the commodity to which the RFID tag is attached is complete if the determination module determines that the commodity is the managed commodity.

2. The commodity information input apparatus according to claim 1, wherein the settlement information sending module sends the settlement information so that a company code in the RFID tag that stores the company code for specifying a company using the RFID tag is overwritten with the settlement information.

3. The commodity information input apparatus according to claim 1, further comprising a controller that causes a display to display a message indicating that the RFID tag is not attached if the determination module determines that the commodity is the managed commodity and if the RFID tag is not detected.

4. The commodity information input apparatus according to claim 1, further comprising a controller that causes a display to display a message instructing a user to remove the RFID tag from the commodity if the determination module determines that the commodity is not the managed commodity.

5. The commodity information input apparatus according to claim 1, further comprising a controller that causes a display to display a message instructing a user to attach a seal to the RFID tag indicating that the commodity is settled if the determination module determines that the commodity is the managed commodity and if writing completion of the settlement information sent by the settlement information sending module is not received.

6. A method for inputting settlement information, comprising:

receiving an input of commodity information for specifying a commodity;

determining, from the commodity information received, whether the commodity specified with the commodity information is a managed commodity that is subject to anti-theft management via a Radio Frequency Identification (RFID) tag attached to the commodity; and sending, to the RFID tag attached to the commodity, settlement information indicating that settlement of the commodity to which the RFID tag is attached is complete if it is determined that the commodity is the managed commodity.

7. A system comprising a commodity information input apparatus in which commodity information for specifying a commodity is input, the commodity information input apparatus comprising an input module configured to receive an input of commodity information, a determination module configured to determine, from the commodity information received by the input module, whether the commodity specified with the commodity information is a managed commodity that is subject to anti-theft management via a Radio Frequency Identification (RFID) tag attached to the commodity, and a settlement information sending module configured to send, to the RFID tag attached to the commodity, settlement information indicating that settlement of the commodity to which the RFID tag is attached is complete if the determination module determines that the commodity is the managed commodity; and an exit detection apparatus which manages an unsettled commodity, the exit detection apparatus comprising an information reception module configured to receive information from the RFID tag attached to the commodity, and a notification module configured to notify an operator of an unsettled message indicating that the commodity is not settled if the information received by the information reception module does not include the settlement information indicating that the commodity is settled.

* * * * *